US011473735B2

(12) United States Patent
Chen et al.

(10) Patent No.: US 11,473,735 B2
(45) Date of Patent: Oct. 18, 2022

(54) LIGHT BULB APPARATUS

(71) Applicant: XIAMEN LEEDARSON LIGHTING CO., LTD, Fujian (CN)

(72) Inventors: Xiaobo Chen, Fujian (CN); Shenggan Wang, Fujian (CN); Mingyan Fu, Fujian (CN); Guanfeng Liu, Fujian (CN); Liangliang Cao, Fujian (CN); Mingli Wei, Fujian (CN); Ran Gao, Fujian (CN); Zhipeng Zhao, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/378,660

(22) Filed: Jul. 17, 2021

(65) Prior Publication Data

US 2022/0042658 A1 Feb. 10, 2022

(30) Foreign Application Priority Data

Aug. 4, 2020 (CN) ..... 202021596819.6
Nov. 16, 2020 (CN) ..... 202022644394.8

(51) Int. Cl.

| | |
|---|---|
| ***F21K 9/235*** | (2016.01) |
| ***F21V 23/00*** | (2015.01) |
| ***F21V 31/00*** | (2006.01) |
| ***F21K 9/232*** | (2016.01) |
| ***F21V 23/04*** | (2006.01) |
| ***F21K 9/238*** | (2016.01) |

(52) U.S. Cl.
CPC ..... *F21K 9/235* (2016.08); *F21K 9/232* (2016.08); *F21K 9/238* (2016.08); *F21V 23/003* (2013.01); *F21V 23/04* (2013.01); *F21V 31/005* (2013.01)

(58) Field of Classification Search
CPC ..... F21K 9/235; F21V 23/003; F21V 23/04; F21V 31/005
See application file for complete search history.

(56) References Cited

U.S. PATENT DOCUMENTS

| | | | | |
|---|---|---|---|---|
| 6,168,282 | B1 * | 1/2001 | Chien | F21V 23/0442 362/228 |
| 10,683,969 | B2 * | 6/2020 | Jeswani | F21K 9/278 |
| 2012/0127692 | A1 * | 5/2012 | Chien | H05B 47/11 362/84 |
| 2018/0288847 | A1 * | 10/2018 | Halliwell | F21V 23/003 |
| 2019/0086037 | A1 * | 3/2019 | Cairns | F21V 31/005 |
| 2020/0263838 | A1 * | 8/2020 | Pyshos | F21K 9/235 |

* cited by examiner

*Primary Examiner* — William N Harris
(74) *Attorney, Agent, or Firm* — Chun-Ming Shih; Lanway IPR Services

(57) ABSTRACT

A light bulb includes a bulb shell, a light source, a driver, a head housing and a bottom switch. The light source is enclosed by the bulb shell for emitting a light through the bulb shell. The driver converts an external power to a driving current supplied to the light source. The head housing has an Edison cap. The head housing is coupled to the bulb shell. The driver is enclosed by the head housing. The Edison cap is plugged to an Edison socket for receiving the external power source. The bottom switch is disposed on the bottom of the Edison cap for changing a setting of the driver.

8 Claims, 14 Drawing Sheets

LIGHT BULB APPARATUS

FIELD

The present invention is related to a light bulb apparatus, and more particularly related to a light bulb apparatus with a bottom switch.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Various light bulbs are widely used in different environments. Some light bulbs are used for a simple purpose while some others are used for special functions.

It is important to provide more flexibility to enhance the value of light bulbs. However, it is not easy to add a switch to a light bulb.

Therefore, it is beneficial if a new way to provide more function of light bulbs.

SUMMARY

In some embodiments, a light bulb includes a bulb shell, a light source, a driver, a head housing and a bottom switch.

The light source is enclosed by the bulb shell for emitting a light through the bulb shell.

The driver converts an external power to a driving current supplied to the light source.

The head housing has an Edison cap.

The head housing is coupled to the bulb shell.

The driver is enclosed by the head housing.

The Edison cap is plugged to an Edison socket for receiving the external power source.

The bottom switch is disposed on the bottom of the Edison cap for changing a setting of the driver.

In some embodiments, the bottom switch has a groove for a tool to insert into the groove to rotate the bottom switch to change the setting.

In some embodiments, the light source includes a LED filament fixed by a glass base.

The glass base is fixed to the bulb shell forming a closing container for containing the LED filament.

Two electrodes pass through the glass base for electrically connecting the LED filament and the driver.

In some embodiments, the driver has a driver plate and a control switch.

The bottom switch is connected to the control switch for changing the setting of the driver.

In some embodiments, the control switch is a rotation switch with a rotation unit rotated by the bottom switch.

In some embodiments, the rotation switch has a top opening facing to the bottom switch.

In some embodiments, the driver plate has a tube for the bottom switch to plug in to carry the control switch.

In some embodiments, the light bulb may also include an aligning structure for aligning the control switch with the bottom switch.

In some embodiments, the bottom switch is surrounded by a plastic ring on the Edison cap.

In some embodiments, the plastic ring elastically engages the bottom switch for proventing water to enter the head housing.

In some embodiments, the bottom switch has a magnet unit.

The driver detects a position of the magnet unit for determining the setting.

In some embodiments, the bottom switch has a pin switch for selecting the setting.

In some embodiments, the bottom switch is a replaceable bar.

The setting is changed by using different replaceable bar to plug to the Edison cap.

The driver detects a type of the replaceable bar to determine the setting.

In some embodiments, the replaceable bar has a color label corresponding to a light parameter of the light source associated with the setting.

In some embodiments, the bottom switch includes an electric insulator and a metal electrode.

The metal electrode guides the external power to the driver and the electric insulator triggers a change of the setting of the driver.

In some embodiments, the bottom switch is a one-time setting switch to be fixed after being used.

In some embodiments, the driver generates the driving current based on the setting corresponding to a working parameter of the light source so that the driver supports multiple types of the light source by adjusting the setting of the driver corresponding to the light source installed in the bulb shell.

In some embodiments, the bottom switch is a rotation switch to be operated continuously for determining the setting to adjust a light intensity of the light source.

In some embodiments, the bottom switch is a screw.

A depth of the screw to be inserted into a screw tube determines the setting of the driver.

In some embodiments, the bottom switch is pulled to change the setting and pushed back to keep the setting unchanged.

DETAILED DESCRIPTION

Figure 9:
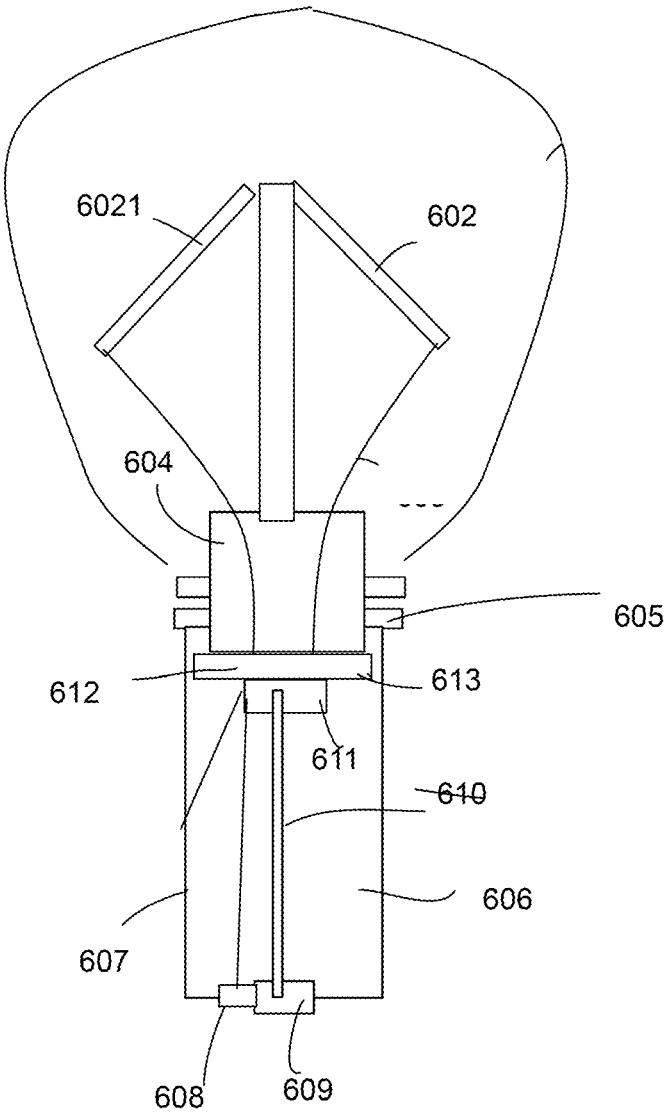
FIG. 9 shows an embodiment of a light bulb embodiment.

In FIG. 9, a light bulb includes a bulb shell 601, a light source 602, a driver 612, a head housing 605 and a bottom switch 609.

The light source 602 is enclosed by the bulb shell 601 for emitting a light through the bulb shell 601.

The driver 612 converts an external power, e.g. a 110V AC power, to a driving current supplied to the light source 602.

The head housing 605 has an Edison cap 606. The Edison cap 606 has two electrodes 607, 608. One electrode is located at a lateral wall of the Edison cap 606 and the other electrode is located at a bottom of the Edison cap 606. In some embodiments, the bottom switch 609 is integrated with the electrode 608. In some other embodiment, the bottom switch 609 is separate from the electrode 608.

The head housing 605 is coupled to the bulb shell 601.

The driver 612 is enclosed by the head housing 605. In some embodiment the head housing 605 has a heat sink or a wrapper housing connected to the Edison cap 606. In some other embodiments, the head housing 605 is the Edison cap 606.

The Edison cap 606 is plugged to an Edison socket, which is a standard component well known to persons of ordinary skilled in the art and thus are not shown in the drawing, for receiving the external power source.

The bottom switch 609 is disposed on the bottom of the Edison cap 606 for changing a setting of the driver 612. The setting may be associated a light parameter of the light source 602. For example, the light parameter may be a color temperature, a color, a color intensity and/or their combination. The driver 612 controls multiple types of the light source 602 to mix a required light parameter.

In some embodiments, the bottom switch 609 has a groove for a tool to insert into the groove to rotate the bottom switch to change the seting.

Figure 4:
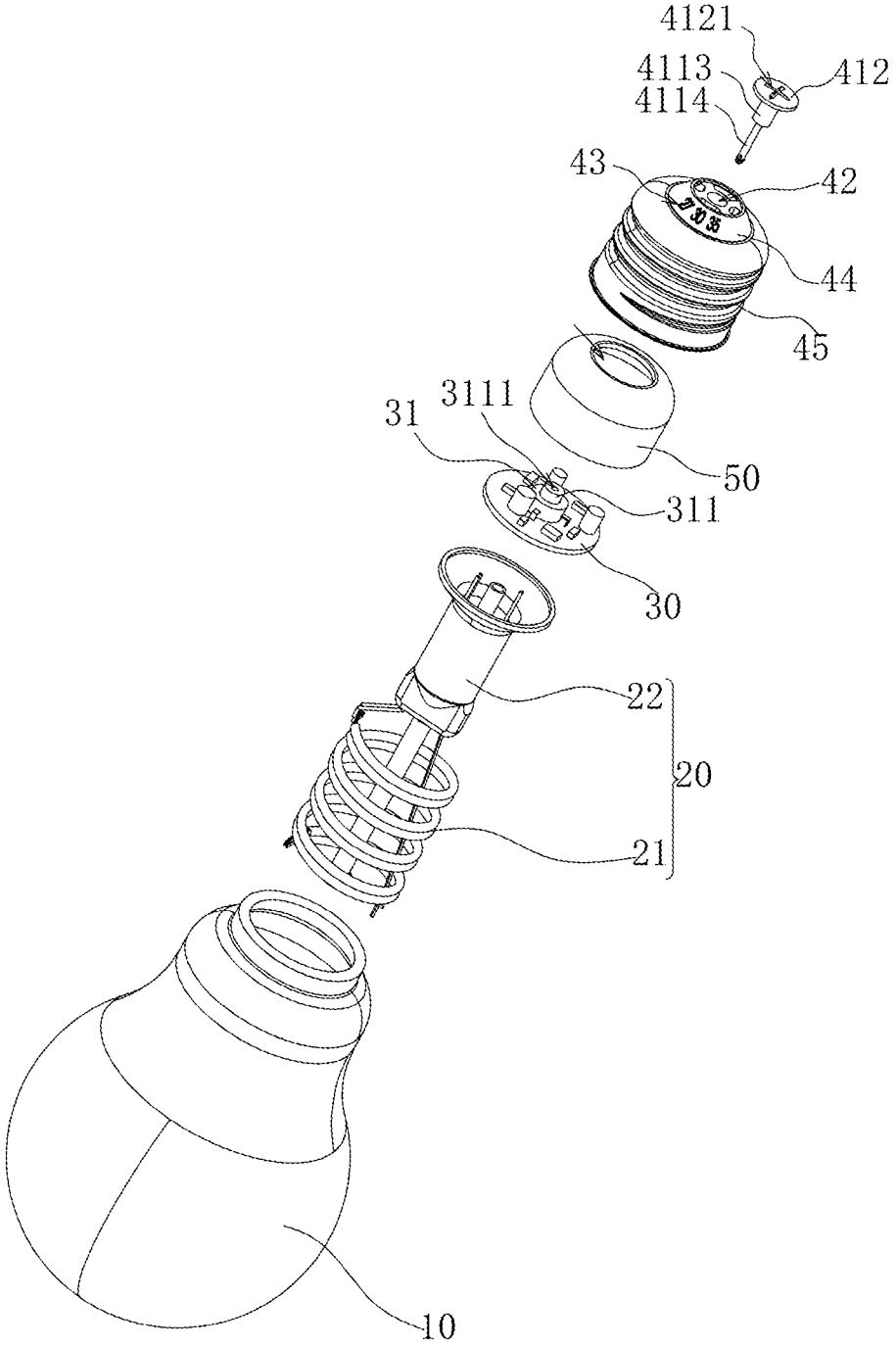
FIG. 4 illustrates an exploded view of the example in FIG. 1.

For example, FIG. 4 shows a bottom switch 411 with a groove 4121 that is easily to be rotated with a screw driver.

In FIG. 9, the light source 602 includes a LED filament 6021 fixed by a glass base 604. The glass base 604 may be made with a glass molding process. Two electrodes 603 are partly embedded in the glass base 604 for electrically connecting the light source 602 and the driver 612.

The glass base 604 is fixed to the bulb shell 601 forming a closing container for containing the LED filament. Heat dissipation gas may be filled in the closing container or protection gas to be filled in the closing container to protect the light source 602.

Two electrodes pass through the glass base for electrically connecting the LED filament and the driver.

In some embodiments, the driver 612 has a driver plate 613 and a control switch 611.

The bottom switch 609 is connected to the control switch 611 for changing the setting of the driver 612.

In some embodiments, the control switch 611 is a rotation switch with a rotation unit rotated by the bottom switch.

For example, FIG. 4 shows a rotation switch 31 with a rotating hole as a rotation unit to be connected to a lever of the bottom switch 411.

In some embodiments, the rotation switch has a top opening facing to the bottom switch, as shown in FIG. 4.

Figure 10:
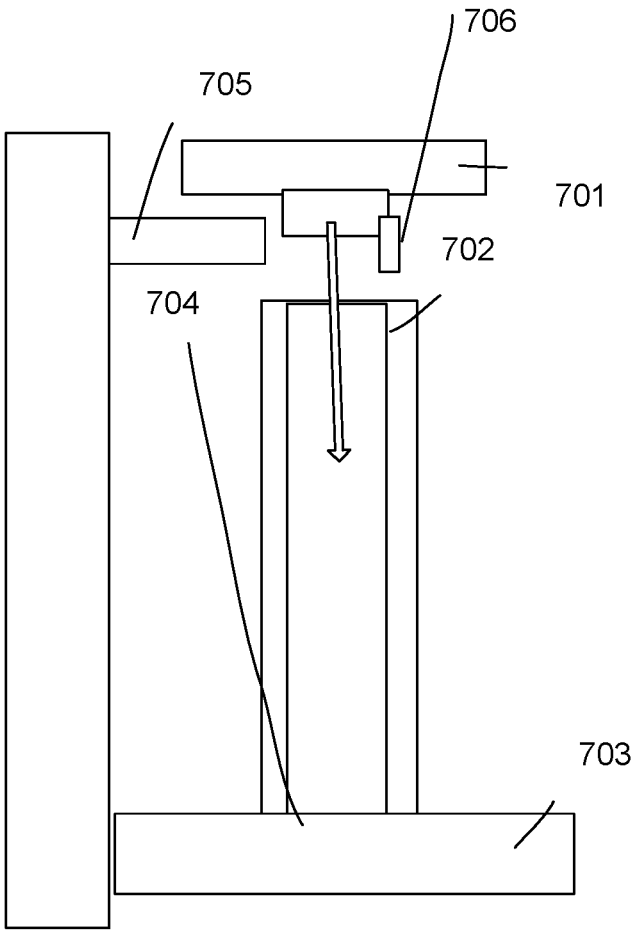
FIG. 10 shows an aligning structure example.

In FIG. 10, the driver plate 703 has a tube 702 for the bottom switch 701 to plug in to carry the control switch 704.

In some embodiments, the light bulb may also include an aligning structure 705 for aligning the control switch 704 with the bottom switch 701.

In some embodiments, the bottom switch is surrounded by a plastic ring on the Edison cap.

For example, FIG. 4 shows a plastic ring 44 to surround the bottom switch 411.

In some embodiments, the plastic ring elastically engages the bottom switch for preventing water to enter the head housing.

In FIG. 10, the bottom switch has a magnet unit 706.

The driver detects a position of the magnet unit for determining the setting. For example, a magnetic force detector is placed on the control switch to detect a position of the magnet unit 706.

Figure 11:
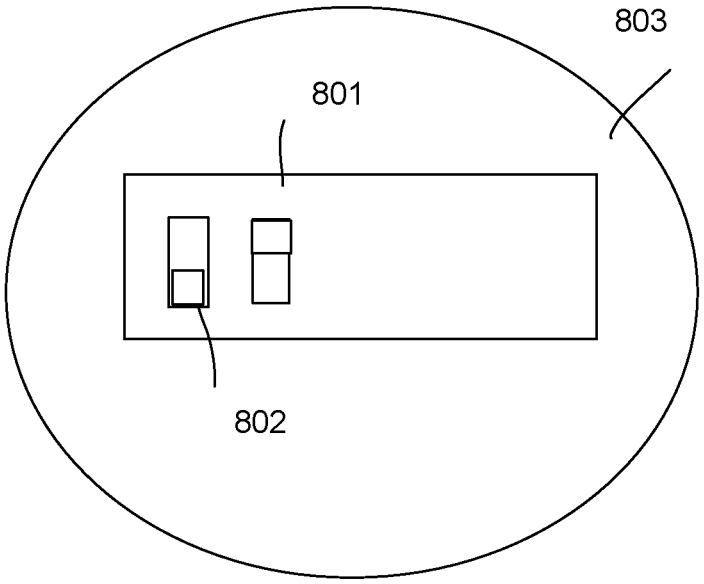
FIG. 11 shows a pin switch example.

In FIG. 11, the bottom switch 803 has a pin switch 801 with selected pin 802 for selecting the setting.

Figure 12A:
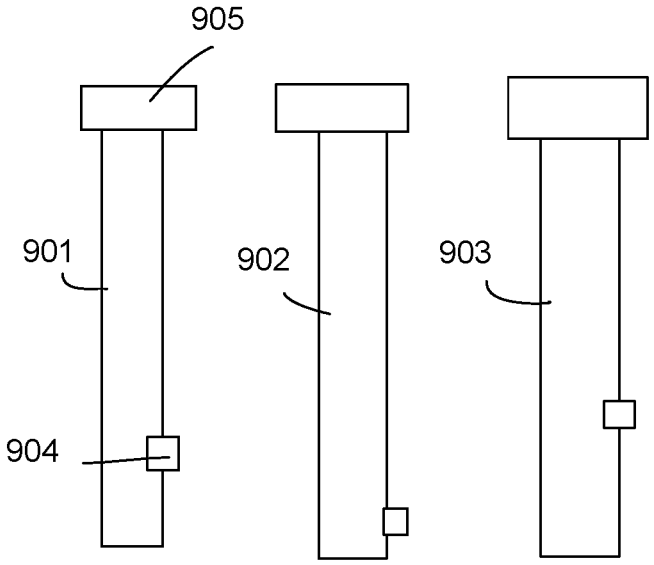
FIG. 12A show a replaceable bar example.

In some embodiments, the bottom switch is a replaceable bar. For example, FIG. 12A shows three replaceable bars 901, 902, 903 to be selected to insert into the Edison cap. There is a color label 905 on the top to indicate the setting. Users select a desired setting and a corresponding replaceable bar 901. The replaceable bar 901 may have a different unit 904 to indicate the driver the type of the replaceable bar 901.

The setting is changed by using different replaceable bar to plug to the Edison cap.

The driver detects a type of the replaceable bar to determine the setting.

In some embodiments, the replaceable bar has a color label corresponding to a light parameter of the light source associated with the setting.

In FIG. 9, the bottom switch includes an electric insulator and a metal electrode. The bottom switch 609 is made of electric insulating material while the electrode 608 is made of metal material.

The metal electrode guides the external power to the driver and the electric insulator triggers a change of the setting of the driver. For example, the bottom switch is a plastic unit triggering a movement of the control switch of the driver to change the setting. Such arrangement may further enhance safety of users.

In some embodiments, the bottom switch is a one-time setting switch to be fixed after being used. For example, factories may select a group of light bulbs to have a first setting. The bottom switch is set to the desired setting and then is fixed not to be changed by a user. Such way may use some common components like drivers while keeping great flexibility to reduce overall cost.

For example, manufacturers may want to make several groups of light bulbs with some common parts like the driver and the heading cap but with different light source. With such design, manufacturers may assemble different light sources. For each light source, the driver is adjusted by changing the setting to fit the requirements of the light source or a technical requirement of the light bulb apparatus.

In some embodiments, the driver generates the driving current based on the setting corresponding to a working parameter of the light source so that the driver supports multiple types of the light source by adjusting the setting of the driver corresponding to the light source installed in the bulb shell.

Figure 5:
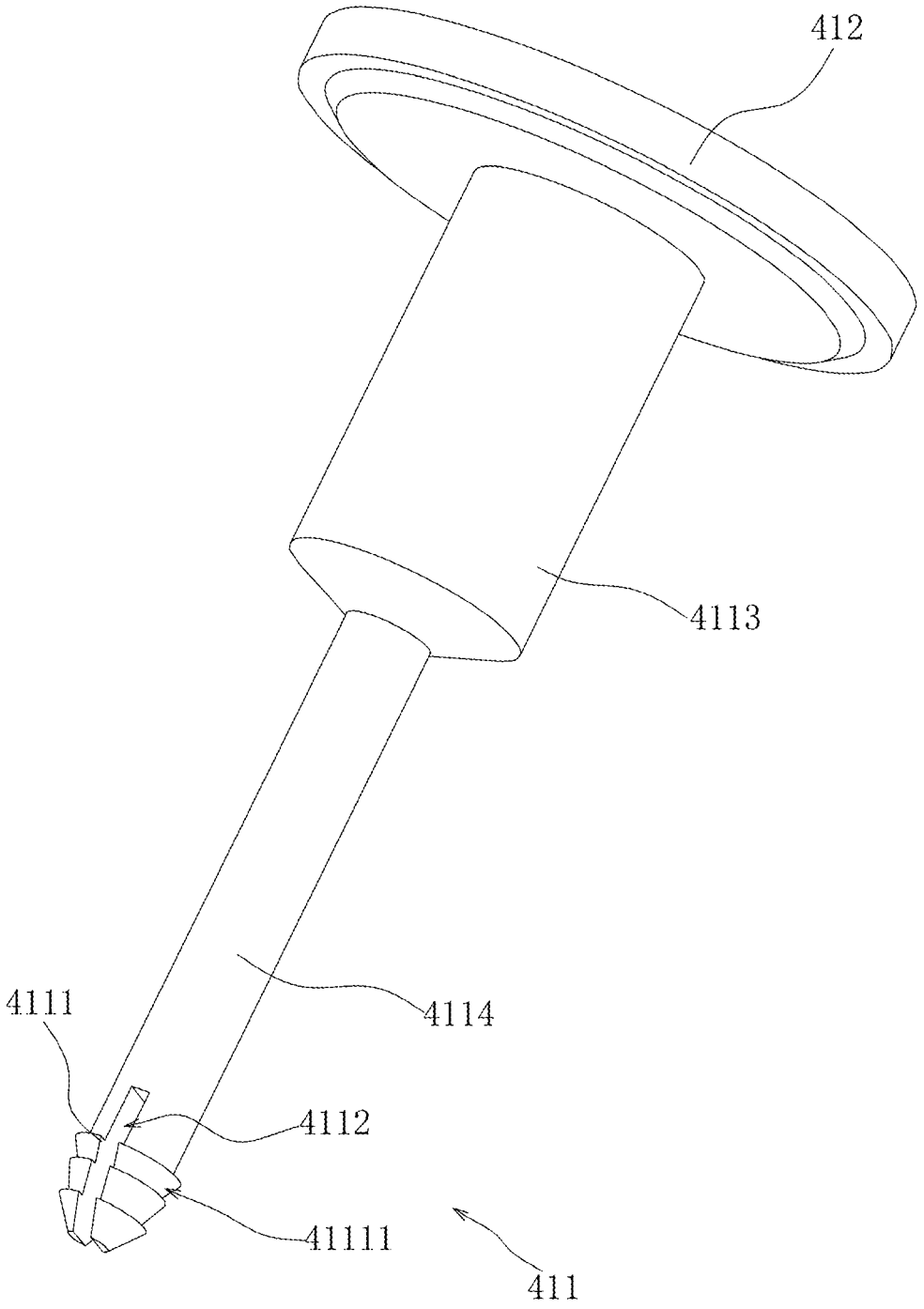
FIG. 5 illustrates a component of a bottom switch.

In some embodiments, the bottom switch is a rotation switch to be operated continuously for determining the setting to adjust a light intensity of the light source. For example, FIG. 5 shows a bottom switch 411 with a lever to trigger a setting of a control switch of the driver. Users may need maximum of the light intensity in some cases, but may determine to use a lower light intensity before the setting is changed to save energy or to control light distribution of a place.

In some embodiments, the bottom switch is a screw.

A depth of the screw to be inserted into a screw tube determines the setting of the driver.

Figure 12B:
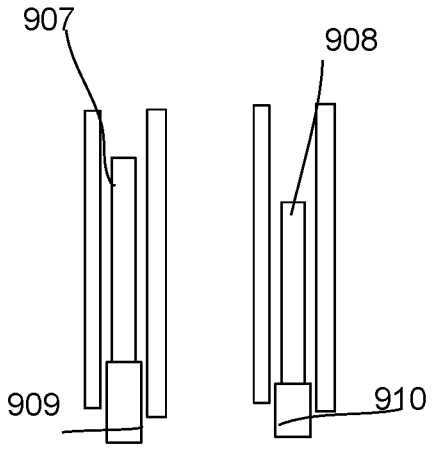
FIG. 12B shows a screw setting example.

In FIG. 12B, the screw 907 is inserted into a screw hole to press a sensor 909 of a control switch of the driver with a first depth with respect to the edge of the bottom switch.

The screw 908 is inserted with a different depth to trigger a different setting of the control switch 910.

In some embodiments, the bottom switch is pulled to change the setting and pushed back to keep the setting unchanged.

Figure 13A:
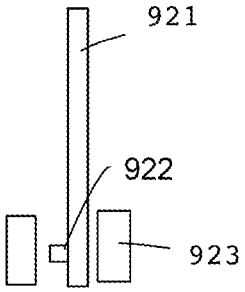
FIG. 13A shows a switch moving a unit of a control switch.
Figure 13B:
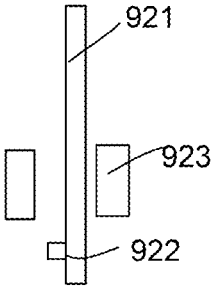
FIG. 13B shows the switch in FIG. 13A is pushed, disabling its function even the switch is rotated.

In FIG. 13A, the bottom switch 921 has a pin 922 to trigger a gear device 923 of the control switch of the driver to change the setting. In FIG. 13B, the bottom switch 921 is pressed so that the pin 922 does not engage the gear device 923 even the pin 922 is rotated with to the gear device 923.

Figure 1:
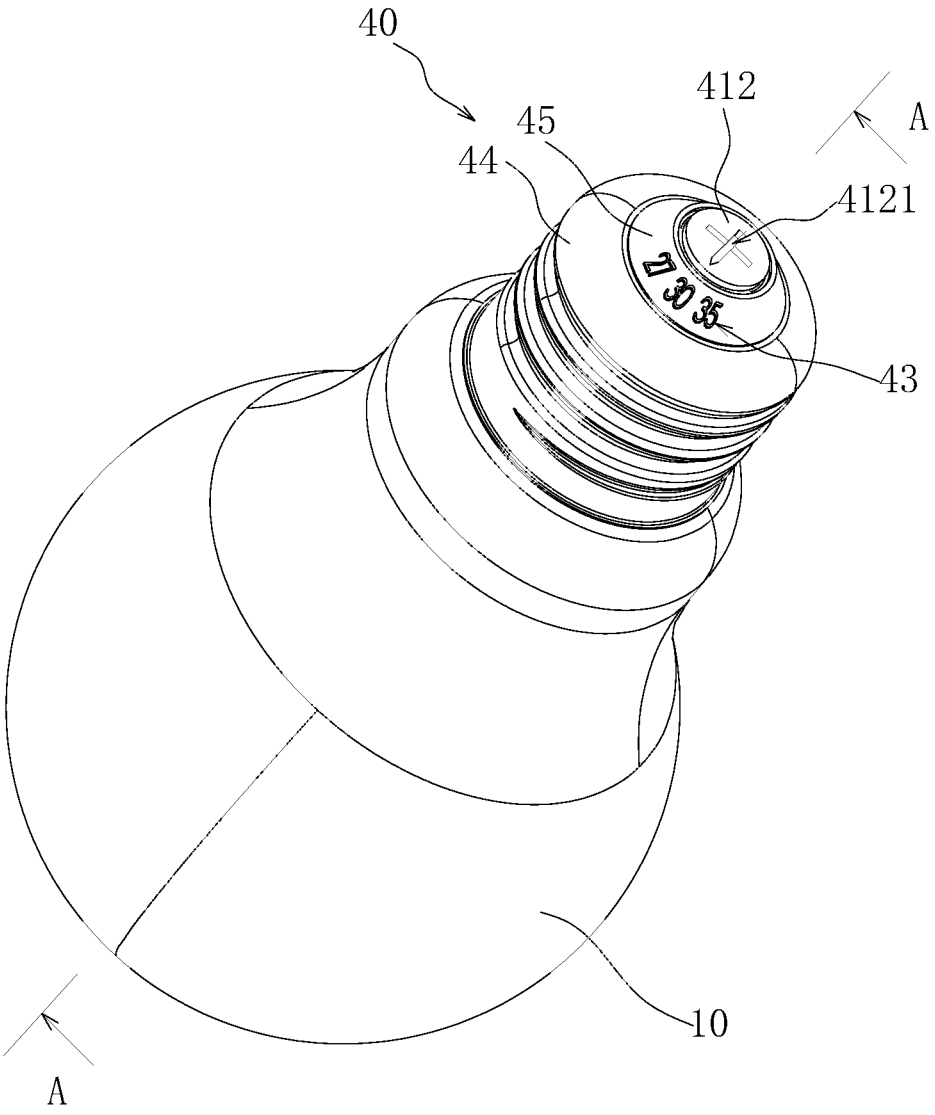
FIG. 1 illustrates a light bulb embodiment.

FIG. 1 shows a light bulb embodiment. In FIG. 1, the bottom switch 411 has a groove 4121 for a user to rotate to change a setting. Users may use a screw driver to rotate the groove to move the groove.

There is a plastic ring 44 marked with several labels 43 corresponding to different settings. The plastic ring 44 may have an elastic force to firmly enclose the bottom switch cover 412 to prevent water to move in the head housing 40. The head housing has an Edison cap 44 to be inserted to an Edison socket. The head housing 40 is attached to a bulb shell 10.

Figure 2:
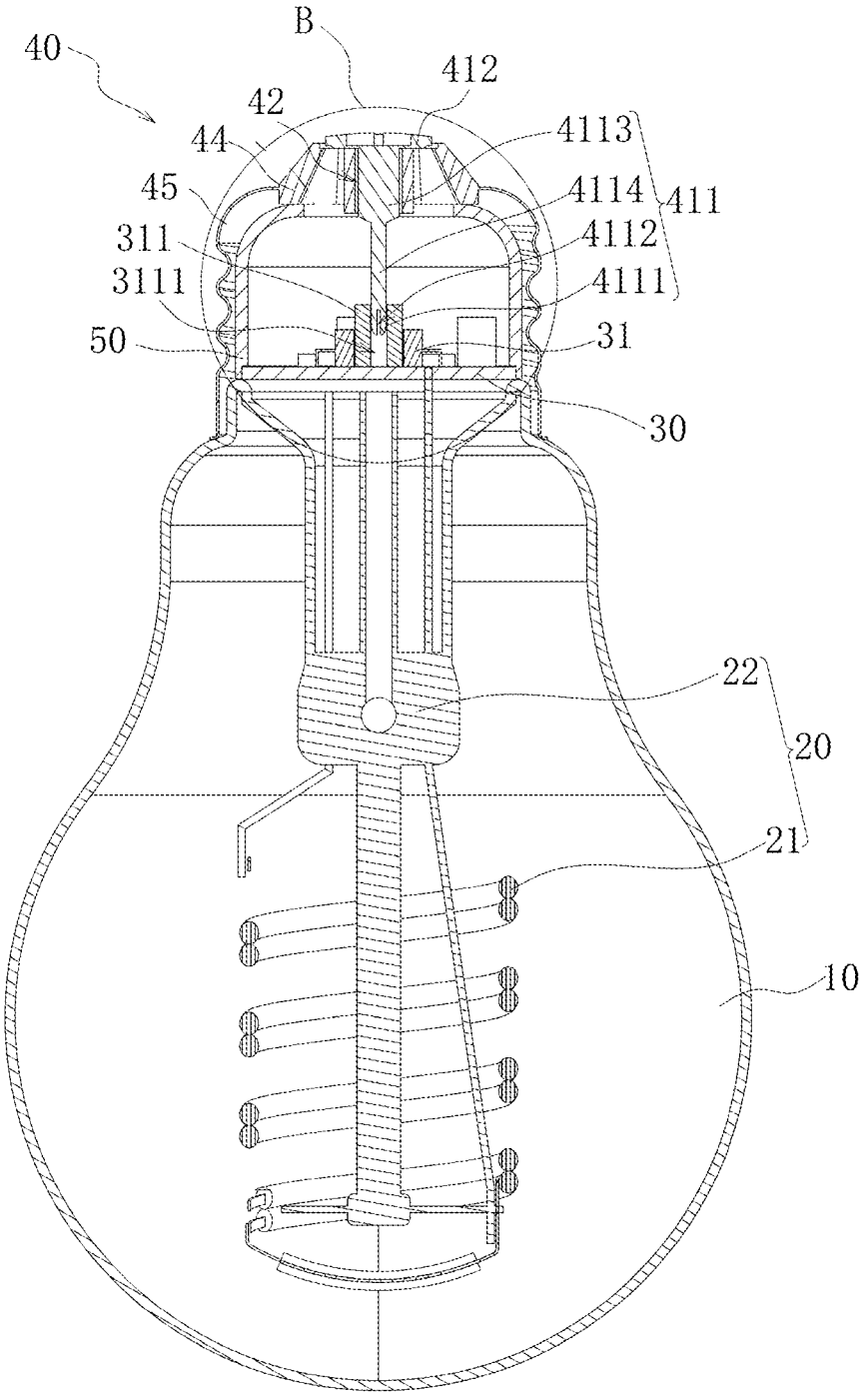
FIG. 2 illustrates a cross-sectional view of the example in FIG. 1.
Figure 3:
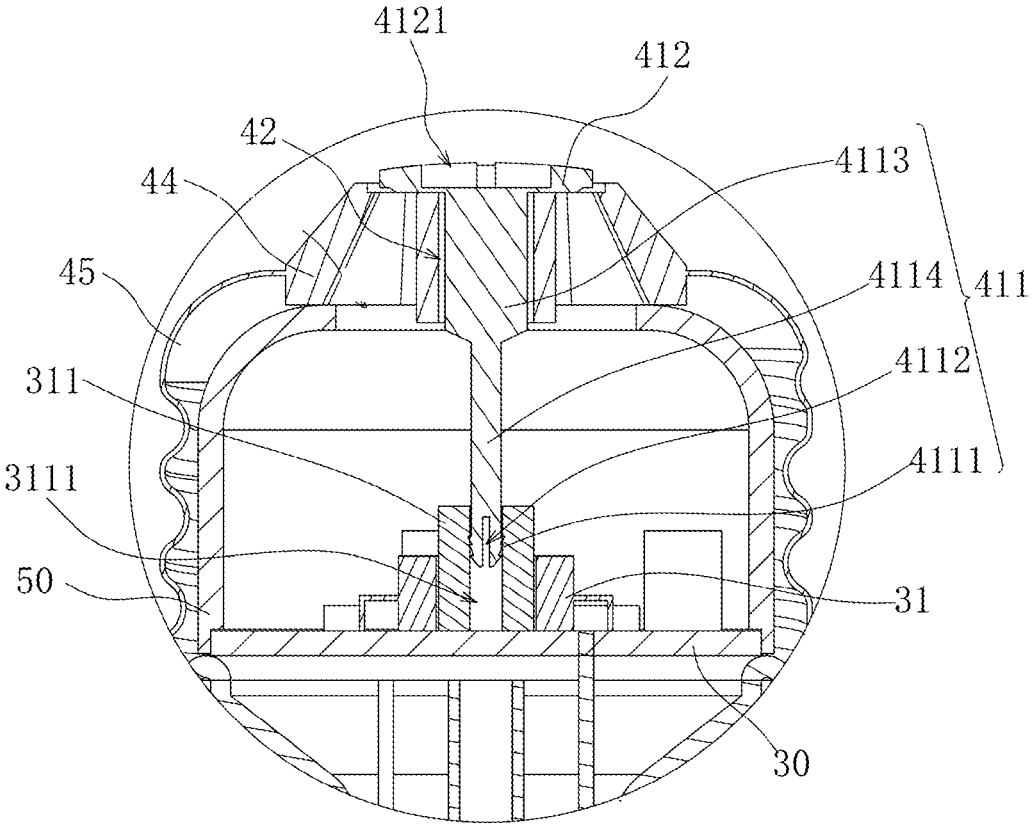
FIG. 3 illustrates a zoom-up view of an area of the example in FIG. 2.

FIG. 2, FIG. 3 and FIG. 4 show a cross-sectional view of the example in FIG. 1. FIG. 3 shows a zoom-up view of a portion of components in FIG. 2. FIG. 4 show an exploded view of the example in FIG. 2. The same reference numerals among drawings refer to the same components.

The bottom switch 411 has the bottom switch cover 412 and a pin 4113, a lever 4114 and head units 4112, 4111. The driver 30 has a rotation switch 31 as the control switch mentioned above.

There is a heat sink inner cup 50 to enclose the driver 30. The rotation switch 31 has a tube 311 and a pin 3111 to be carried to move by the bottom switch 411. There is a plastic area 44 to isolate the bottom switch 411 and the lateral electrode 45 of the Edison cap.

The light bulb apparatus has a light source 21 and a glass base 22 forming a light module 20, which are enclosed by the bulb shell 10.

FIG. 5 shows a bottom switch 411 with a pin 4113 which transfers a rotation of the bottom switch 411 via the pin 4113 and lever 4114. To switch heads 4111, 4112 has a protruding surface 41111 to carry a rotation switch of the control switch of the driver to move to change a setting, e.g. change a resistor value.

Figure 6:
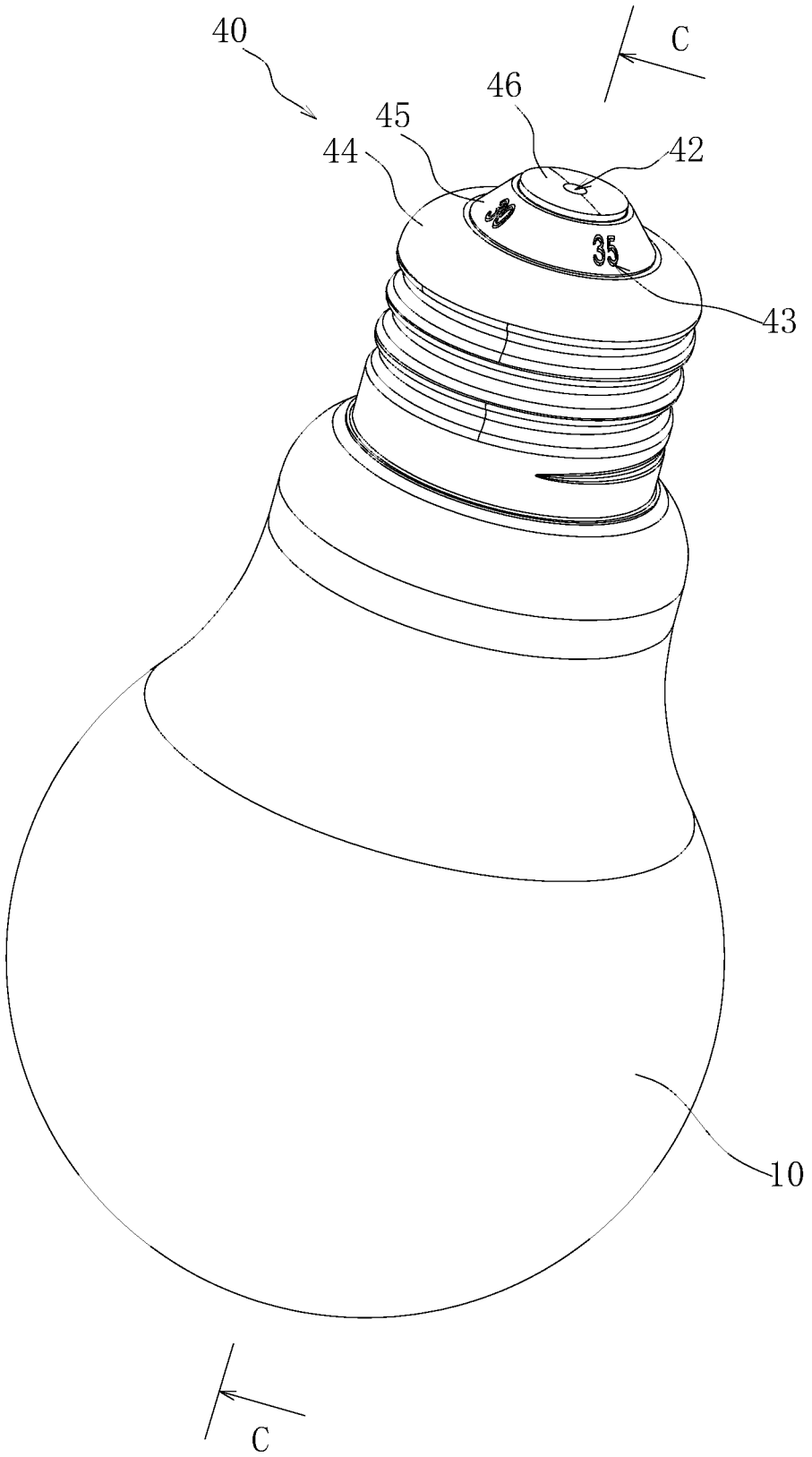
FIG. 6 illustrates another embodiment.

FIG. 6 shows another example. In this example, a bottom switch 411 has a bottom switch cover 46. Other components are like the example in FIG. 1 and are not repeated again.

Figure 7:
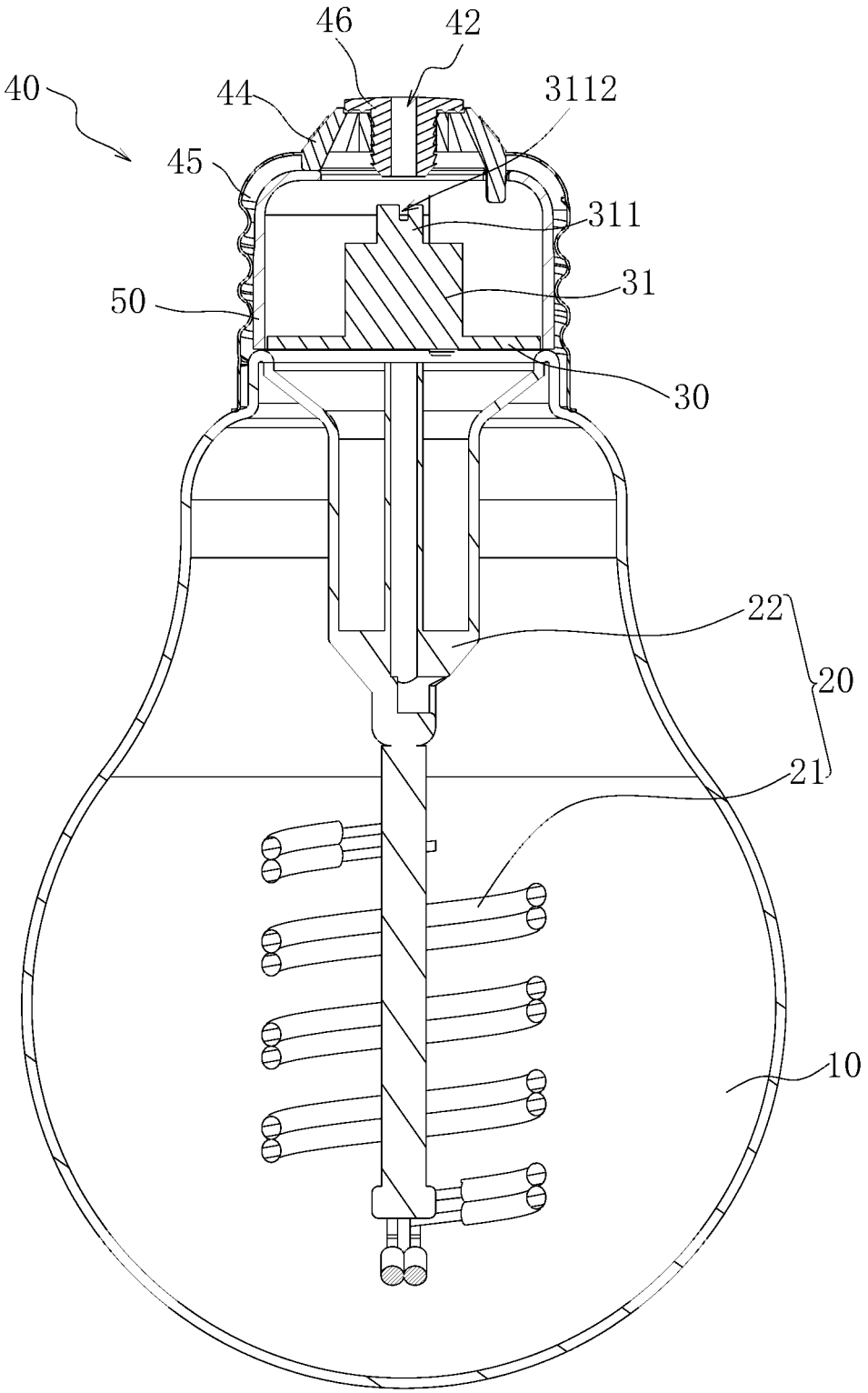
FIG. 7 illustrates a cross-sectional view of the example in FIG. 6.

FIG. 7 shows a cross-sectional view illustrating a different structure of the bottom switch. In FIG. 7, the bottom switch 411 does not have a protruding pin extending to the rotation switch 31. In FIG. 7, the rotation switch 31 has a protruding top 3112 on the rotation switch 311.

Figure 8:
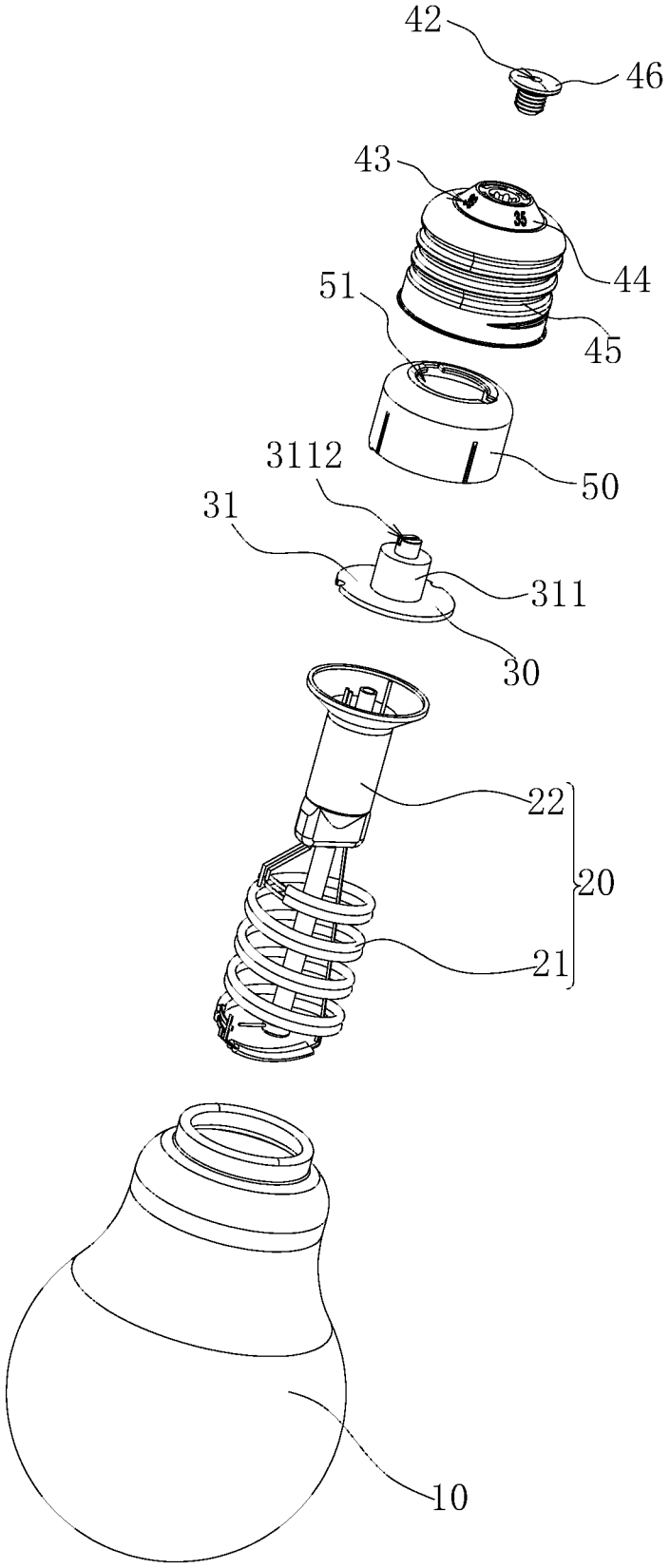
FIG. 8 illustrates an exploded view of the example in FIG. 6.

FIG. 8 shows an exploded view of the example in FIG. 7. Unlike the example in FIG. 1, the example in FIG. 7 and FIG. 8 show another way to trigger the rotation switch of the control switch of the driver.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light bulb apparatus, comprising:

a bulb shell;

a light source enclosed by the bulb shell for emitting a light through the bulb shell;

a driver for converting an external power to a driving current supplied to the light source;

a head housing with an Edison cap, wherein the head housing is coupled to the bulb shell, wherein the driver is enclosed by the head housing, wherein the Edison cap is plugged to an Edison socket for receiving the external power; and a bottom switch disposed on the bottom of the Edison cap for changing a setting of the driver, wherein the driver has a driver plate and a control switch, wherein the bottom switch is connected to the control switch for changing the setting of the driver, wherein the driver plate has a tube for the bottom switch to plug in to carry the control switch.

2. The light bulb of claim 1, wherein the bottom switch has a groove for a tool to insert into the groove to rotate the bottom switch to change the setting.

3. The light bulb of claim 1, wherein the light source comprises a LED filament fixed by a glass base, wherein the glass base is fixed to the bulb shell forming a closing container for containing the LED filament, wherein two electrodes pass through the glass base for electrically connecting the LED filament and the driver.

4. The light bulb of claim 1, wherein the control switch is a rotation switch with a rotation unit rotated by the bottom switch.

5. The light bulb of claim 4, wherein the rotation switch has a top opening facing to the bottom switch.

6. The light bulb of claim 1, wherein the bottom switch is surrounded by a plastic ring on the Edison cap.

7. The light bulb of claim 6, wherein the plastic ring elastically engages the bottom switch for preventing water to enter the head housing.

8. The light bulb of claim 1, wherein the bottom switch is a rotation switch to be operated continuously for determining the setting to adjust a light intensity of the light source.

* * * * *